US012551030B1

(12) United States Patent
Turner

(10) Patent No.: US 12,551,030 B1
(45) Date of Patent: Feb. 17, 2026

(54) CHILD CARE MANNEQUIN WITH ADJUSTABLE CRADLING ARMS

(71) Applicant: Tiffany Nicole Turner, Mebane, NC (US)

(72) Inventor: Tiffany Nicole Turner, Mebane, NC (US)

( * ) Notice: Subject to any disclaimer, the term of this patent is extended or adjusted under 35 U.S.C. 154(b) by 0 days.

(21) Appl. No.: 18/970,847

(22) Filed: Dec. 5, 2024

(51) Int. Cl.
*A47D 13/08* (2006.01)
*A47D 13/00* (2006.01)
*A47D 15/00* (2006.01)

(52) U.S. Cl.
CPC ..... *A47D 13/08* (2013.01); *A47D 15/005* (2013.01); *A47D 13/00* (2013.01); *A47D 15/00* (2013.01)

(58) Field of Classification Search
CPC ..... A47D 13/08; A47D 13/00; A47D 15/005; A47D 15/008; A47D 15/00
USPC ..... 5/630, 632, 655, 657, 904
See application file for complete search history.

(56) References Cited

U.S. PATENT DOCUMENTS 4,197,604 A * 4/1980 Nakamura ..... A47G 9/1045 446/72
5,700,059 A * 12/1997 Moscot ..... A47D 15/006 297/452.17
6,918,770 B2 * 7/2005 Odiwo ..... A47D 15/006 434/266
7,107,639 B2 * 9/2006 Taricani ..... A47D 13/08 5/915
7,386,902 B2 * 6/2008 Wilson ..... A61J 9/0607 5/639
7,464,424 B1 * 12/2008 Formica ..... A47D 13/025 5/915
7,475,441 B1 * 1/2009 Soberal ..... A47D 9/057 5/904
7,587,772 B2 * 9/2009 Ward ..... A47D 13/066 5/904
8,127,384 B2 * 3/2012 Carlton ..... A47D 13/08 5/639
8,782,827 B2 * 7/2014 Shane ..... A47D 13/025 5/105
11,529,278 B2 * 12/2022 Diaz ..... A47D 15/001
2004/0077287 A1 4/2004 Odiwo
(Continued)

FOREIGN PATENT DOCUMENTS

CN 103961196 A 8/2014
ES 2319088 A1 5/2009

*Primary Examiner* — Robert G Santos
(74) *Attorney, Agent, or Firm* — Gugliotta & Gugliotta LPA

(57) ABSTRACT

A child care mannequin provides a hands-free solution for holding sleeping infants by simulating the physical and sensory experience of being held by a caregiver. The device includes a female-form torso structure with padded breasts and stomach regions, along with adjustable arms having interlocking fingers that form a secure cradle. The mannequin is supported by a height-adjustable base and includes comfort features such as a heartbeat sound mechanism, gentle rocking motion, and voice recording/playback capabilities. Support straps attach to hooks on the torso to secure the infant, while integrated storage pockets hold baby care essentials. The torso can be covered with a caregiver's worn clothing to provide familiar scent. The device safely supports infants up to twenty-five pounds while allowing caregivers to attend to other tasks without disturbing the baby's sleep.

20 Claims, 2 Drawing Sheets

(56) References Cited

U.S. PATENT DOCUMENTS

| | | | | |
|---|---|---|---|---|
| 2005/0278854 | A1* | 12/2005 | Taricani | A47D 13/08 5/655 |
| 2007/0074348 | A1* | 4/2007 | Carlton | A47D 13/08 5/915 |
| 2007/0079444 | A1* | 4/2007 | Ward | A47D 15/003 5/904 |
| 2007/0094799 | A1 | 5/2007 | Wilson | |
| 2007/0277309 | A1 | 12/2007 | Shane et al. | |
| 2013/0145556 | A1 | 6/2013 | Kummerfeld et al. | |
| 2014/0082839 | A1 | 3/2014 | Piombino | |
| 2019/0282420 | A1* | 9/2019 | Diaz | A47D 15/001 |
| 2023/0131055 | A1 | 4/2023 | Prakash | |

* cited by examiner

CHILD CARE MANNEQUIN WITH ADJUSTABLE CRADLING ARMS

CROSS-REFERENCE TO RELATED APPLICATIONS

There are no previously filed, nor currently any co-pending applications, anywhere in the world.

BACKGROUND OF THE INVENTION

1. Field of the Invention

The present invention relates to an infant care device that simulates the physical presence and comfort of being held by a caregiver while allowing hands-free operation, specifically addressing the challenge of maintaining infant sleep and comfort during transitions between being held and being placed in a sleeping surface.

2. Description of the Related Art

Parents and caregivers have long faced a challenging dilemma when caring for infants—babies often strongly prefer to be held, particularly during sleep, yet caregivers cannot physically hold them continuously. This creates a significant practical problem as caregivers need to attend to other tasks, rest themselves, or care for other children. The issue is especially pronounced during nap times and bedtime transitions.

When a baby falls asleep in a caregiver's arms, transferring them to a crib or bassinet frequently results in the baby waking up. This disrupts the baby's sleep cycle and creates a cycle of sleep deprivation for both infant and caregiver. Traditional solutions like cribs, bassinets, and even modern baby swings fail to fully replicate the specific comfort elements that make being held so soothing for infants—the warmth, heartbeat, familiar scent, and secure embrace that characterizes being held by a primary caregiver.

The physical and emotional toll on caregivers can be substantial. The constant need to hold an infant can lead to physical fatigue, inability to accomplish necessary tasks, and increased stress levels. This situation can be particularly challenging for single parents, working parents who need to handle household duties during nap times, or those without extensive support systems. Additionally, the inability to put a baby down can impact the caregiver's ability to care for themselves, potentially leading to exhaustion and burnout.

While various products exist to help soothe babies—from traditional cribs to sophisticated electronic rockers—there remains a gap in the market for a solution that truly replicates the multisensory experience of being held by a caregiver. Current alternatives typically address only one aspect of infant comfort, such as movement (rockers) or position (loungers), but fail to integrate the full range of sensory elements that make being held so effective for infant sleep and comfort.

This persistent need has created an opportunity for innovation in infant care products—specifically, for a solution that can provide the comprehensive comfort of being held while allowing caregivers the freedom to attend to other necessary tasks. Such a solution would need to address not only the physical aspects of holding a baby but also the sensory elements that make maternal holding so effective for infant comfort and sleep.

SUMMARY OF THE INVENTION

It is thus an object of the present invention to provide a device that allows caregivers to safely transfer sleeping infants from their arms without disturbing their sleep by eliminating the transfer entirely through a secure, anthropomorphic holding apparatus that replicates the multi-sensory experience of being held.

It is a feature of the present invention to provide an anthropomorphic torso structure with adjustable, interlocking arms designed to securely cradle an infant while simulating the physical characteristics and sensory experience of being held by a caregiver, particularly a mother.

The present invention provides The present invention provides a novel solution to the common challenge of caring for infants who need to be held during sleep. This innovation, known as the "Other Mommy," is designed to simulate the comforting experience of being held by a caregiver while providing a safe, hands-free solution for parents and caregivers. At its core, the invention comprises a female torso structure extending from shoulders to waist, featuring soft breasts and a supportive "mommy belly" that provides comfortable underlying support for the infant. The device's distinguishing feature is its system of adjustable arms with interlocking fingers that form a secure cradle, capable of safely holding infants weighing up to twenty-five pounds. This cradling system is mounted on an adjustable height stand with a wide, stable base to prevent tipping.

The invention incorporates several features designed to replicate the sensory experience of being held by a caregiver. A mechanical heartbeat mechanism embedded in the left chest area creates a soothing, familiar environment. The device can be dressed with a shirt worn by the primary caregiver, providing the comfort of familiar scent. Additional practical features include a storage pocket for baby care essentials such as bottles, diapers, or burp cloths.

In its enhanced version, the device includes additional comfort features such as a gentle side-to-side rocking mechanism and a recording feature that allows caregivers to record their voice for playback. The invention is constructed from hypoallergenic materials including rubber, silicone, and durable plastic, with PVC pipe providing structural support. It is available in different skin tones to better match family preferences.

This invention serves as an alternative to traditional cribs and bassinets, particularly beneficial during nap times or when caregivers need to attend to other tasks while ensuring their infant remains safely and comfortably held. The design emphasizes both security and comfort, providing a practical solution that maintains the nurturing aspects of being held while offering caregivers necessary flexibility in their daily routines.

It is an advantage of the present invention to provide caregivers with a hands-free solution for holding sleeping infants while maintaining the comfort and security of being held.

It is another advantage of the present invention to eliminate the need for potentially disruptive transfers of sleeping infants from arms to cribs or bassinets.

It is another advantage of the present invention to simulate multiple comfort aspects of being held, including heartbeat sounds, familiar scent, and secure embrace, in a single integrated device.

It is another advantage of the present invention to provide adjustable, interlocking arms that safely secure infants of varying sizes while maintaining a natural holding position.

It is another advantage of the present invention to allow caregivers to attend to other tasks while ensuring their infant remains safely and comfortably held.

It is another advantage of the present invention to promote longer, uninterrupted sleep periods for infants by maintaining consistent comfort conditions.

It is another advantage of the present invention to reduce physical strain on caregivers who would otherwise need to hold their infants for extended periods.

It is another advantage of the present invention to provide a safe alternative to traditional cribs and bassinets that better meets the comfort needs of infants who prefer being held.

It is another advantage of the present invention to offer customization through adjustable height settings and the ability to incorporate a caregiver's worn clothing for familiar scent.

It is another advantage of the present invention to provide convenient storage solutions for essential baby care items through integrated pockets while maintaining the primary holding function.

Further features of the invention will become apparent in the course of the following description.

BRIEF DESCRIPTION OF DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
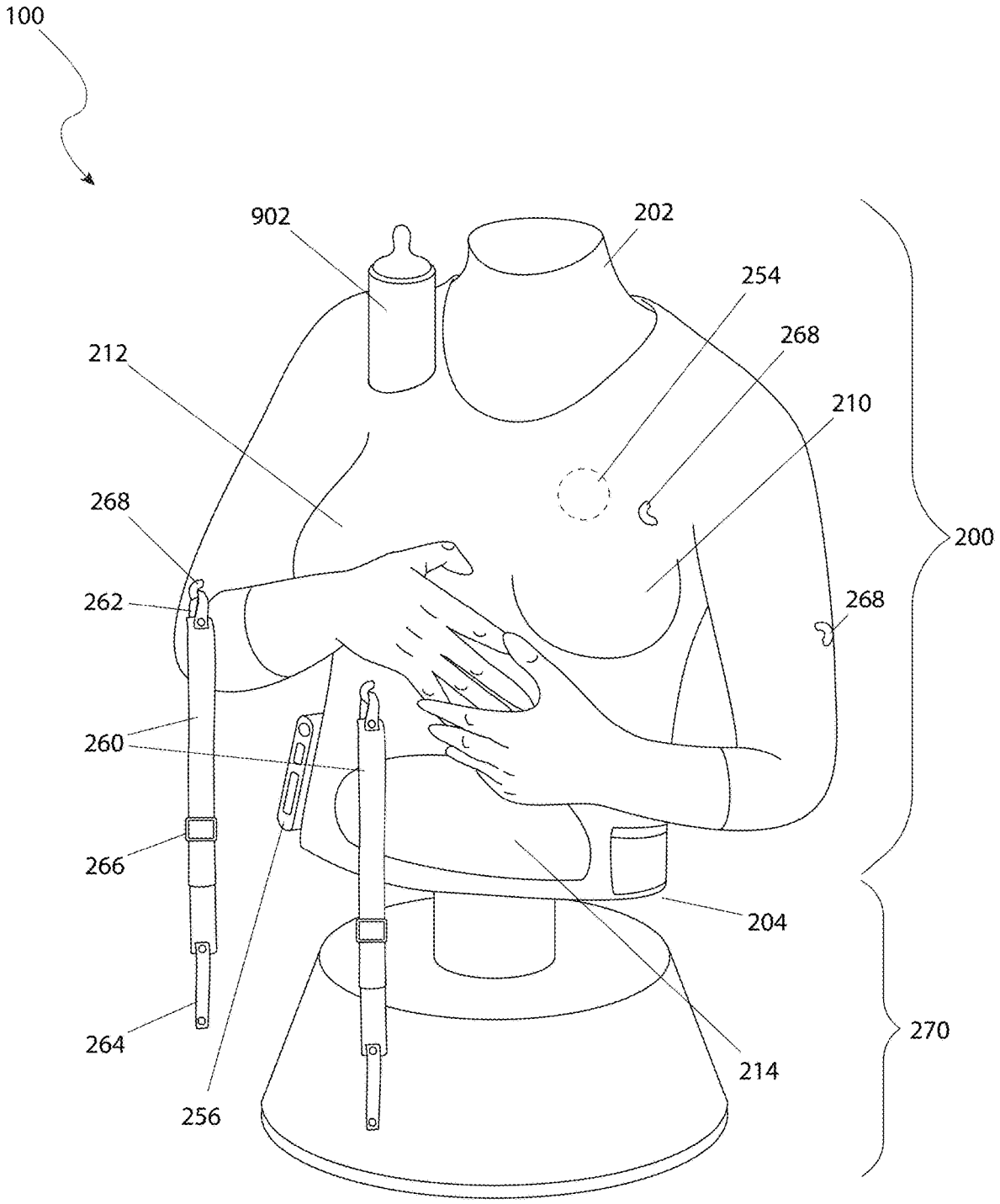
FIG. 1 is a front isometric view of a child care mannequin 100, according to an embodiment of the present invention; and, FIG. 2 is a front isometric view of a child care mannequin 100, according to an embodiment of the present invention, illustrating the mannequin left arm 220 and mannequin right arm 230 adjusted to form the cradling position 290.
Figure 2:
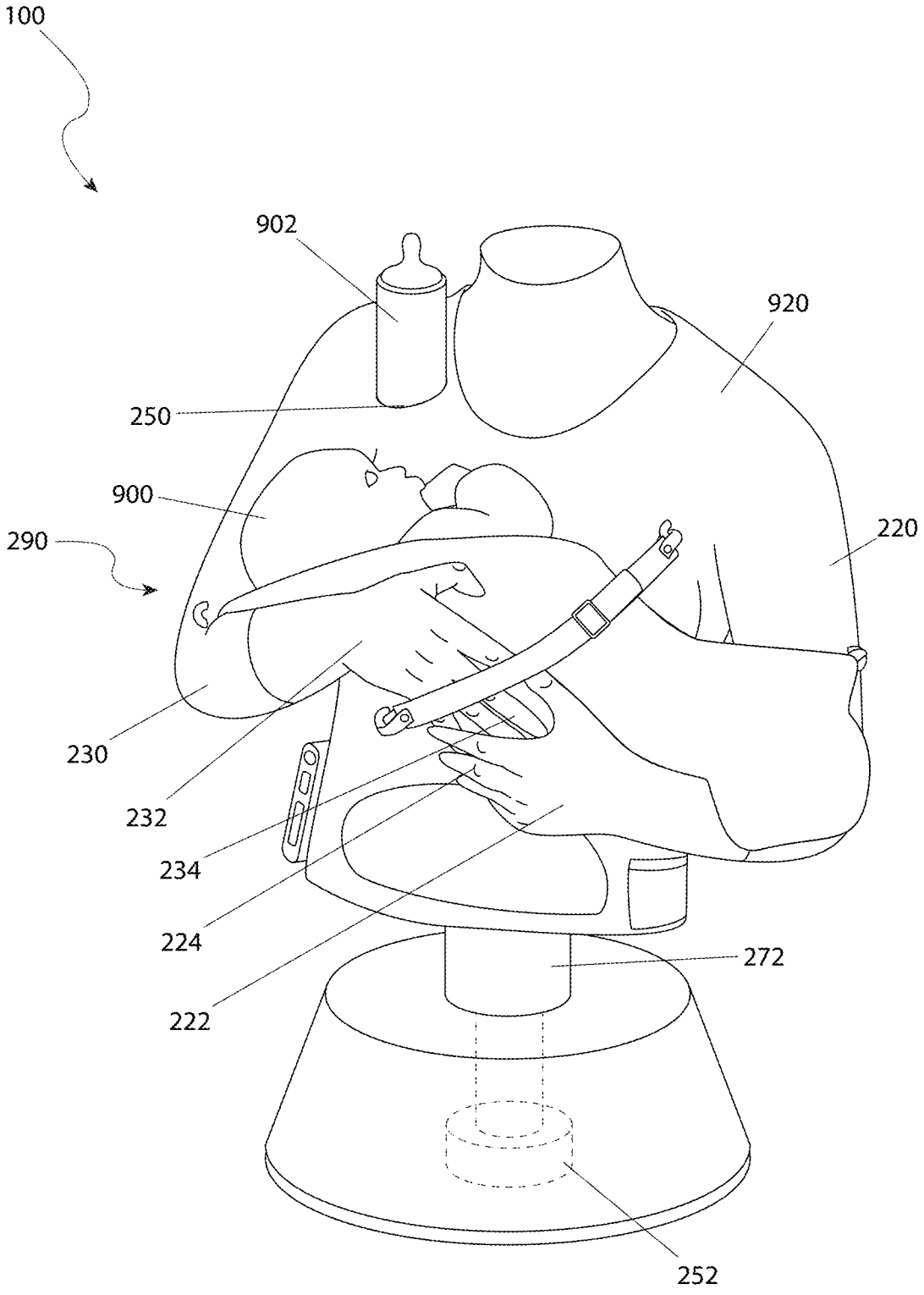

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, The present invention is directed to a child care mannequin (herein described as the "invention") 100. The invention 100 may comprise a mannequin torso 200, mannequin arms, a base 270, and one (1) or more support straps 260. The invention 100 may be adapted to hold an infant 900 by cradling the infant 900 between the mannequin torso 200 and the mannequin arms. The positioning of the mannequin arms may be adjustable to adapt the invention 100 to the size of the infant 900. The base 270 may support the mannequin torso 200 in a stable and upright orientation. The support straps 260 may be adapted to couple to a plurality of strap hooks 268 positioned on the mannequin torso 200 and/or the mannequin arms in order to secure the infant 900 and/or support a bottle 902.

The mannequin torso 200 may be adapted to resemble a female body from the neck 202 to the waist 204. The mannequin torso 200 may comprise a left breast 210, a right breast 212, and a stomach 214. The left breast 210, the right breast 212, and the stomach 214 may be padded such that the mannequin torso 200 comprises non-rigid areas. The stomach 214 may extend outward to mimic the appearance and feel of the mother's stomach after giving birth, also known as "mommy tummy". As a non-limiting example, the left breast 210, the right breast 212, and the stomach 214 may have the firmness of a bean bag. In some embodiments, the padded stomach region comprises a bean bag-like filling providing flexible support.

The mannequin arms may comprise a mannequin left arm 220 and a mannequin right arm 230 coupled to the mannequin torso 200 at the left shoulder and the right shoulder, respectively. The mannequin arms may be adjustable arms such that the mannequin torso 200 may be covered by a T-shirt 920 that holds the mother's scent.

The mannequin left arm 220 may comprise a left hand 222 with left fingers 224 and the mannequin right arm 230 may comprise a right hand 232 with right fingers 234. The mannequin arms may be adjusted such that the left fingers 224 interlock with the right fingers 234 to hold the mannequin arms in a cradling position 290. The mannequin arms, the stomach 214, the left breast 210, and the right breast 212 may be adapted to support the infant 900 within the cradling position 290.

The skin may be defined to be the outermost layer of the mannequin torso 200 and the mannequin arms. The invention 100 may be available with a choice of skin color. As non-limiting examples, a user may be able to choose the skin to mimic Caucasian, African, or Asian skin tones and/or a choice of shades covering light skin to dark skin.

In some embodiments, the skin of the mannequin torso 200 and the mannequin arms may be a hypoallergenic material.

The base 270 may be located under the mannequin torso 200 and may support the mannequin torso 200 in a stable and upright orientation. The bottom of the base 270 may be wider than the mannequin torso 200 in order to keep the center of gravity of the invention 100 over the base 270. In some embodiments, the base 270 may comprise a height adjuster 272 that enables the height of the mannequin torso 200 to be adjusted up and down.

The support straps 260 may be adapted to couple to the plurality of strap hooks 268 positioned on the mannequin torso 200 and/or the mannequin arms in order to secure the infant 900 and/or support the bottle 902. An individual support strap 260 may comprise a first attachment loop 262. And a second attachment loop 264 that may be coupled to the plurality of strap hooks 268. In some embodiments, the individual support strap 260 may comprise an elastic material such that the individual support strap 260 may retain tension. In some embodiments, the individual support strap may comprise a length adjuster 266 such that the length of the individual support strap 260 may be changed.

In some embodiments, the mannequin torso 200 may comprise one (1) or more storage pockets 250 for storing items. As non-limiting examples, the storage pockets 250 may hold the bottle 902, a pacifier, a burp cloth, or a diaper.

In some embodiments, the invention 100 may comprise a rocking mechanism 252 adapted to move the infant 900 back and forth. As a non-limiting example, the rocking mechanism 252 may cause the mannequin torso 200 to oscillate gently to the left and right. The rocking mechanism 252 may be incorporated into the mannequin torso 200 or into the base 270. In either case, the rocking mechanism 252 may cause the mannequin torso 200 to move in a side-to-side motion.

In some embodiments, the mannequin torso 200 may comprise a heartbeat sound unit 254. The heartbeat sound unit 254 may create an audible sound within the mannequin torso 200. The sound created by the heartbeat sound unit 254 may be adapted to emulate the sound of a mother's heartbeat which may be soothing to the infant 900.

In some embodiments, the invention 100 may comprise a voice recorder and playback unit 256. The voice recorder and playback unit 256 may be adapted to record a mother's voice and to play the mother's voice back to the infant 900.

2. Operation of the Preferred Embodiment

In use, the invention 100 may be placed where the mother may monitor the infant 900 and the mannequin arms may be adjusted to form the cradling position 290. The infant 900 may be placed into the cradling position 290 where the infant 900 may be supported by the mannequin arms, the stomach 214, the left breast 210, and the right breast 212. The support straps 260 may be coupled to the mannequin torso 200 and/or the mannequin arms to further support the infant 900. The rocking mechanism 252 may be activated to gently rock the infant 900 back and forth. The heartbeat sound unit 254 may be activated to produce a sound that emulates the mother's heartbeat. The mother's voice may be recorded using the voice recorder and playback unit 256. The mother's voice may be played back to the infant 900 at any time using the voice recorder and playback unit 256.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

The invention claimed is:

1. A child care mannequin comprising:

a mannequin torso configured to resemble a female body from neck to waist, said mannequin torso comprising:
- a left breast and a right breast;
- a stomach region extending outward to provide underlying support specifically designed to simulate a post-partum abdomen; and
- at least one shoulder;

a pair of adjustable arms coupled to said mannequin torso, comprising:
- a left arm having a left hand with left fingers;
- a right arm having a right hand with right fingers;

wherein said left fingers and right fingers are configured to interlock to form a secure cradling position, said interlocking fingers providing secure support for an infant weighing up to twenty-five pounds; and a base coupled to said mannequin torso and configured to support said mannequin torso in a stable, upright orientation.

2. The child care mannequin of claim 1, wherein said left breast, right breast, and stomach region comprise non-rigid, padded areas.

3. The child care mannequin of claim 1, further comprising a plurality of strap hooks positioned on said mannequin torso and at least one support strap configured to couple to said strap hooks to secure an infant within said cradling position.

4. The child care mannequin of claim 1, wherein said base comprises a height adjuster configured to adjust the vertical position of said mannequin torso.

5. The child care mannequin of claim 1, further comprising a heartbeat sound unit configured to emit sounds simulating a human heartbeat.

6. The child care mannequin of claim 1, further comprising at least one storage pocket integrated into said mannequin torso.

7. The child care mannequin of claim 1, further comprising a rocking mechanism configured to move said mannequin torso in a side-to-side motion, wherein said rocking mechanism is incorporated into said mannequin torso rather than into said base.

8. The child care mannequin of claim 1, further comprising a voice recorder and playback unit configured to record and reproduce audio.

9. The child care mannequin of claim 1, wherein said mannequin torso is configured to be covered by a worn garment to provide a familiar scent to an infant.

10. The child care mannequin of claim 1, wherein said mannequin torso and arms are constructed from hypoallergenic materials.

11. A child care device comprising:

a female-form torso structure comprising padded breast and stomach regions, wherein said stomach region is specifically designed to simulate a post-partum abdomen;

adjustable arms coupled to said torso structure, said arms having interlocking digits configured to form a secure cradle capable of safely supporting an infant weighing up to twenty-five pounds;

a stabilizing base; and at least one comfort feature selected from the group consisting of:

a heartbeat sound generator;

a rocking mechanism;

a voice recording and playback system; and support straps configured to secure an infant.

12. The child care device of claim 11, wherein said stabilizing base comprises a height adjustment mechanism.

13. The child care device of claim 11, further comprising at least one storage compartment integrated into said torso structure.

14. The child care device of claim 13, wherein said torso structure is configured to support an infant weighing up to twenty-five pounds.

15. The child care device of claim 11, wherein said torso structure comprises an exterior surface available in multiple skin tone options.

16. The child care device of claim 11, wherein said padded stomach region comprises the firmness of a bean bag providing flexible support.

17. A method of using a child care mannequin comprising:

providing a female-form torso structure comprising: a left breast and a right breast; a stomach region extending outward to simulate a post-partum abdomen; and at least one shoulder; providing a pair of adjustable arms coupled to said torso structure, comprising: a left arm having a left hand with left fingers; a right arm having a right hand with right fingers;

positioning said adjustable arms of said female-form torso structure to form a cradling position, wherein said left fingers of said left hand and said right fingers of said right hand are interlocked to form said cradling position, said interlocking fingers providing secure support for an infant weighing up to twenty-five pounds;

placing an infant within said cradling position;

securing said infant using support straps coupled to strap hooks on said torso structure; and activating at least one comfort feature selected from the group consisting of:

a heartbeat sound generator located in the left breast area to simulate maternal heartbeat; a rocking mechanism incorporated into said torso structure rather than into a base supporting said torso structure; and a recorded voice playback.

18. The method of claim 17, further comprising covering said torso structure with a worn garment to provide a familiar scent to said infant, wherein said torso structure is constructed from hypoallergenic materials.

19. The method of claim 17, further comprising adjusting a height of said torso structure using a height adjustment mechanism in a base supporting said torso structure, wherein said height adjustment mechanism allows the torso structure to be positioned at a customized height that facilitates transfer of the sleeping infant between a caregiver's arms and the child care mannequin without waking the infant.

20. The method of claim 17, further comprising storing infant care items in at least one storage pocket integrated into said torso structure, wherein said infant care items are selected from the group consisting of bottles, pacifiers, diapers, and burp cloths.

* * * * *